US006164465A

United States Patent [19]

Schroeder

[11] Patent Number: 6,164,465

[45] Date of Patent: Dec. 26, 2000

[54] SPORTS EQUIPMENT RACK

[75] Inventor: Scott Schroeder, Avon, Colo.

[73] Assignees: Patricia O'Neil; John C. Moore, both of Vail, Colo.

[21] Appl. No.: 09/238,695

[22] Filed: Jan. 27, 1999

[51] Int. Cl.[7] ..... A47F 7/00

[52] U.S. Cl. ..... 211/85.7; 211/70.2; 211/70.5; 211/149

[58] Field of Search ..... 211/18, 85.7, 90.01, 211/90.02, 90.04, 99, 104, 149, 150, 13.1, 70.2, 70.5, 60.1

[56] References Cited

U.S. PATENT DOCUMENTS

| | | | |
|---|---|---|---|
| 442,468 | 12/1890 | Wegener | 211/18 |
| 1,380,570 | 6/1921 | Lehman | 211/60.1 |
| 1,664,036 | 3/1928 | Jarvis | 211/90.01 X |
| 2,784,004 | 3/1957 | Hamrick, Jr. | 211/149 X |
| 3,183,862 | 5/1965 | Melvin | 211/149 X |
| 3,650,407 | 3/1972 | Benham, Jr. . | |
| 3,722,652 | 3/1973 | Busch et al. . | |
| 3,826,378 | 7/1974 | Novak . | |
| 3,874,512 | 4/1975 | Wegley et al. . | |
| 4,002,241 | 1/1977 | Parrilla, Sr. . | |
| 4,050,706 | 9/1977 | Kronstadt | 211/60.1 |
| 4,188,890 | 2/1980 | de Villers . | |
| 4,222,490 | 9/1980 | Wood, Jr. . | |
| 4,380,298 | 4/1983 | Harig | 211/189 |
| 4,552,270 | 11/1985 | Lentz et al. | 211/17 |
| 4,688,685 | 8/1987 | Brace . | |
| 4,732,283 | 3/1988 | Schmidt | 211/70.5 |
| 4,813,550 | 3/1989 | Saeks | 211/18 |
| 4,854,456 | 8/1989 | Lee | 211/70.5 |
| 4,936,467 | 6/1990 | Bobeczko . | |
| 4,997,116 | 3/1991 | Grim | 211/18 X |
| 5,044,505 | 9/1991 | Spratt | 211/13 X |
| 5,082,123 | 1/1992 | Lamb . | |
| 5,203,462 | 4/1993 | Brooks . | |
| 5,253,837 | 10/1993 | Loux | 211/90 X |
| 5,257,701 | 11/1993 | Edelson | 211/149 |
| 5,307,944 | 5/1994 | Reedy . | |
| 5,335,794 | 8/1994 | Reedy . | |
| 5,377,849 | 1/1995 | Martin | 211/13 |
| 5,477,968 | 12/1995 | Largent et al. . | |
| 5,492,228 | 2/1996 | Botkin | 211/18 X |
| 5,505,318 | 4/1996 | Goff | 211/150 |
| 5,590,796 | 1/1997 | Herman | 211/149 |
| 5,598,959 | 2/1997 | Lorensen et al. . | |
| 5,617,958 | 4/1997 | Laug et al. | 211/149 X |
| 5,649,633 | 7/1997 | Bellerose . | |
| 5,706,737 | 1/1998 | Whitehead et al. . | |
| 5,743,418 | 4/1998 | Ahrens . | |
| 5,765,702 | 6/1998 | Bustos et al. | 211/149 |
| 5,855,286 | 1/1999 | Zaid | 211/85.7 |

OTHER PUBLICATIONS

Lee Rowan Storage System, on sale in Denver, Colorado, Jun., 1998.

Sitour USA advertisement for Ski/Snowboard/Bike Racks, *NSAA Member Update*, p. 33, Jun./Jul. 1998.

Tension Mount Bike Racks, Item #67–449348 or #67–843508, *Hold Everything Catalog*, p. 28, Apr. 1998.

All–Season Sports Rack, Item #67–898254, *Hold Everything Catalog*, p. 28a, Apr. 1998.

Bike Up and Away, Item BU–A, *Bike Nashbar Catalog*, No. 130, p. 38, Spring 1998.

XP–Pedastyle® Storage System, Items PS–XP and PS–XPF, *Bike Nashbar Catalog*, No. 130, p. 38, Spring 1998.

Two Bike Storage System, Item IL–ENE, *Bike Nashbar Catalog*, No. 130, p. 38, Spring 1998.

Nashbar Bike Cradle, Item BN–BC, *Bike Nashbar Catalog*, No. 130, p. 38, Spring 1998.

*Primary Examiner*—Daniel P. Stodola
*Assistant Examiner*—Jennifer E. Novosad
*Attorney, Agent, or Firm*—Seed I. P. Law Group PLLC

[57] ABSTRACT

A rack for holding a variety of sports equipment has a U-shaped main bracket mounted to a wall. The U-shaped bracket has first and second vertical members, to which pairs of arms are coupled spaced along the length of the frame. Distal ends of one or more sets of the arms are recessed to receive and support a bicycle frame. Horizontal members of various lengths and spacings are coupled to the top surface of the sets of arms, to provide horizontal support surfaces, as well as support for pairs of skis and bags of golf clubs.

8 Claims, 9 Drawing Sheets

SPORTS EQUIPMENT RACK

FIELD OF THE INVENTION

This invention relates to a rack for storing a variety of sports equipment.

BACKGROUND OF THE INVENTION

People with a variety of athletic interests have a need to store various sports equipment when not in use. A majority of sports equipment is large, bulky or awkwardly shaped, making it difficult to store the equipment in a compact, orderly fashion.

Various attempts have been made to develop a rack or system for storing athletic equipment in an organized manner. However, a need still exists for a rack that allows a user to store a wide variety of sports equipment in a compact manner. A need also exists for a sports equipment rack that is versatile, strong and easy to assemble and use. The present invention fulfills these needs, and provides further related advantages.

SUMMARY OF THE INVENTION

Briefly, the present invention provides an improved rack for storing a wide variety of sports equipment in a secure, organized fashion, in a relatively small space. In a preferred embodiment, the rack has a U-shaped main frame that is mounted to a wall, for example, in a garage. The U-shaped frame has a first vertical member and a second vertical member mounted to a vertical support surface in parallel, laterally spaced relation to each other.

A first and second arm are coupled to the first and second vertical members respectively, and extend outward parallel to each other and perpendicular to the vertical support surface. A distal end of each of the first and second arms has a recess to receive and support the frame of a bicycle.

A first horizontal member and a second horizontal member extend laterally across and are coupled to an upper surface of the first and second arms. The first and second horizontal members are sufficiently long such that a portion of the first and second horizontal members extends laterally outward beyond the first and second vertical members. The first and second horizontal members are substantially parallel, and are spaced apart by a distance that is sufficiently narrow to catch and support the curved tips of a pair of skis. Depending on the extent to which the first and second horizontal members extend outward beyond the vertical members, one or more pair of skis may be suspended by their tips to one side of either the first or second vertical member. Ski poles may also be suspended next to the skis, for example by hanging the strap handles of the poles over the end of a horizontal member. In addition to supporting skis, the first and second horizontal members have an upper surface that jointly provide a horizontal support surface on which miscellaneous sports equipment may be placed.

In a preferred embodiment, third and fourth arms are coupled to the first and second vertical members, respectively. Similar to the first and second arms, the third and fourth arms are substantially parallel to each other, and extend outward perpendicular to the vertical support surface. A recess is provided in the distal end of each of the third and fourth arms, to receive and support a typical frame of a bicycle. In order to support two bicycles in staggered relation to each other, the third and fourth arms have a length that differs from the length of the first and second arms. A plurality of horizontally positioned slats extend across and are coupled to an upper surface of the third and fourth arms in parallel spaced relation to each other, to form a shelf. Miscellaneous sporting equipment, for example ski boots, may be placed on the shelf or horizontal support surface formed by the slats.

In a preferred embodiment, fifth and sixth arms are coupled to the first and second vertical members, respectively, in parallel relation to each other, and perpendicular to the vertical support surface. A third horizontal member extends across and is coupled to an upper surface of the fifth and sixth arms proximate the first and second vertical members. A fourth horizontal member extends across and is coupled to the upper surface of the fifth and sixth arms distal to the first and second vertical members. The length of the third and fourth horizontal members is sufficient such that a portion of the third and fourth horizontal members extends outward beyond the first vertical member. In this manner, the third and fourth horizontal members and fifth arm collectively form a U-shaped recess that receives and supports a bag of golf clubs. In a preferred embodiment, additional slats extend across and are coupled to an upper surface of the fifth and sixth arms between the third and fourth horizontal members to form an additional horizontal support surface.

In a preferred embodiment, seventh and eighth arms are coupled to the first and second vertical members, respectively, in parallel relation to each other and perpendicular to the vertical support surface. A plurality of horizontally oriented slats are coupled to the seventh and eighth arms, to form another horizontal support surface on which a bottom of the bag of golf clubs may rest, in addition to other miscellaneous sporting equipment.

In this manner, a rack provided in accordance with the present invention allows a user to store multiple bicycles, skis, golf clubs, ski boots, footballs, rackets, and various other sports equipment in an organized, compact fashion. Also, in a preferred embodiment, the arms are pivotally coupled to the first and second vertical members, thereby allowing the arms and associated shelves to be folded up against the wall when not in use.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE INVENTION

Figure 1:
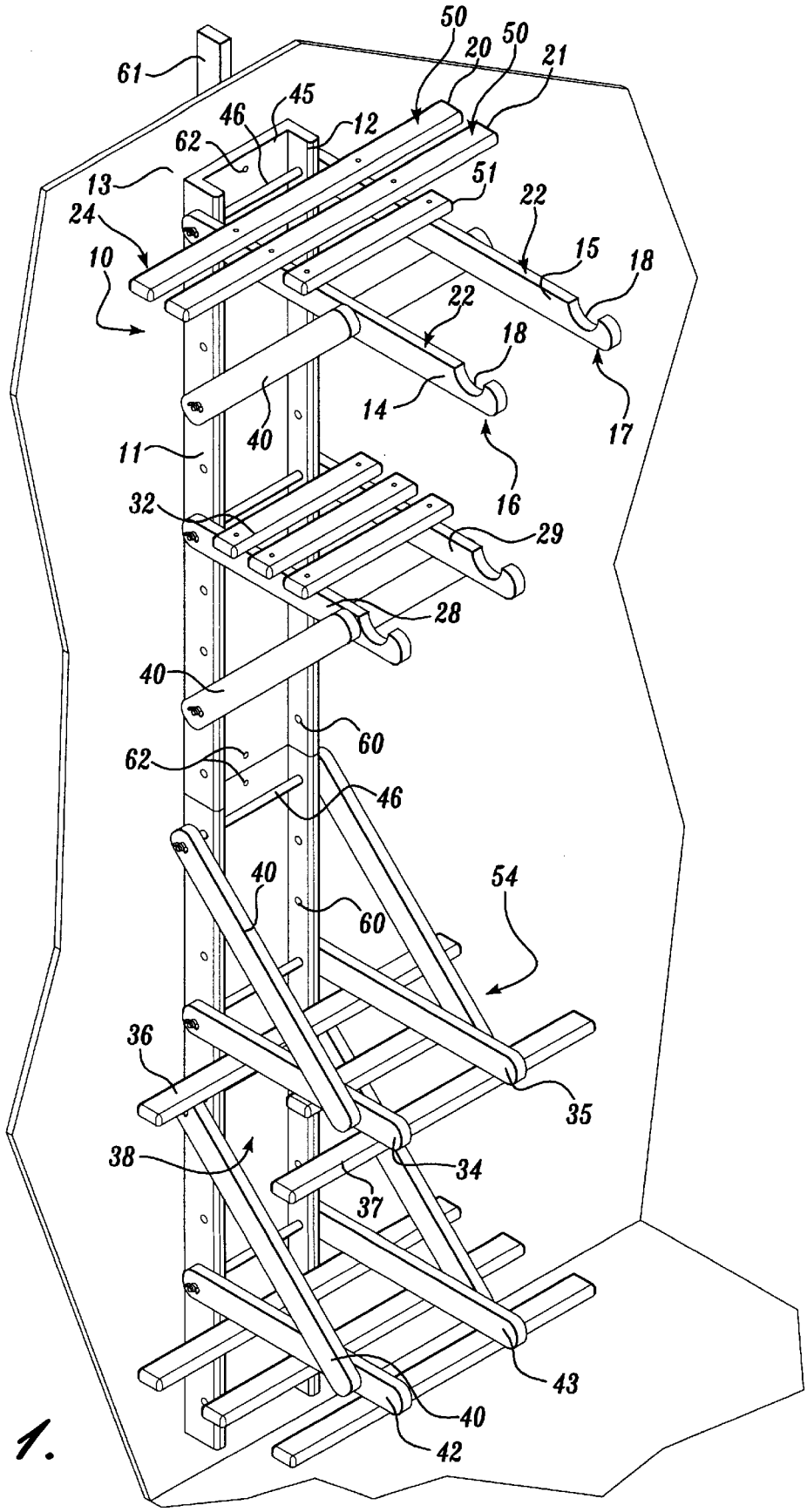
FIG. 1 is a front isometric view of a rack provided in accordance with a preferred embodiment of the present invention.
Figure 2:
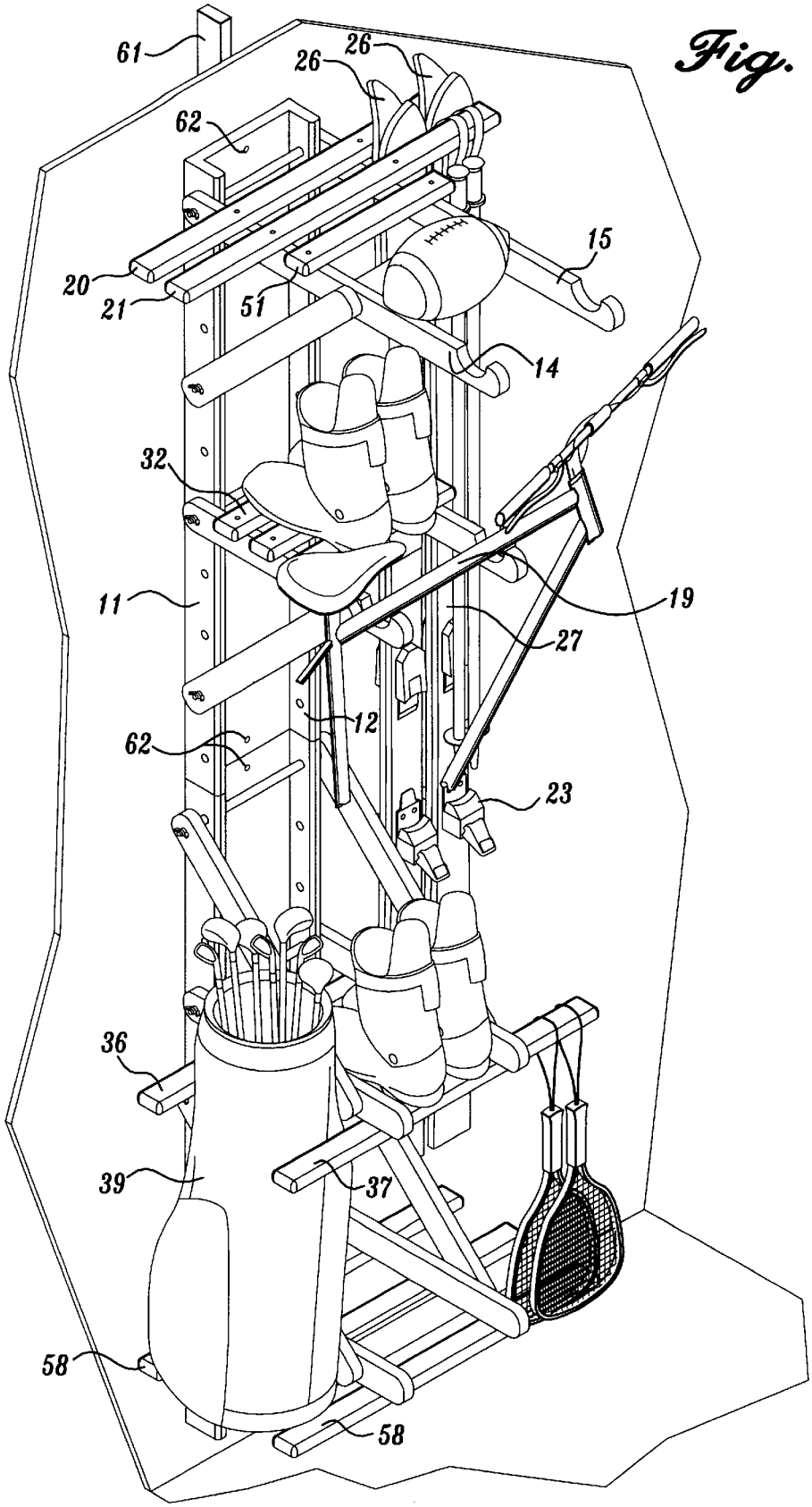
FIG. 2 is a front isometric view of the rack of FIG. 1, supporting a variety of sports equipment.
Figure 3:
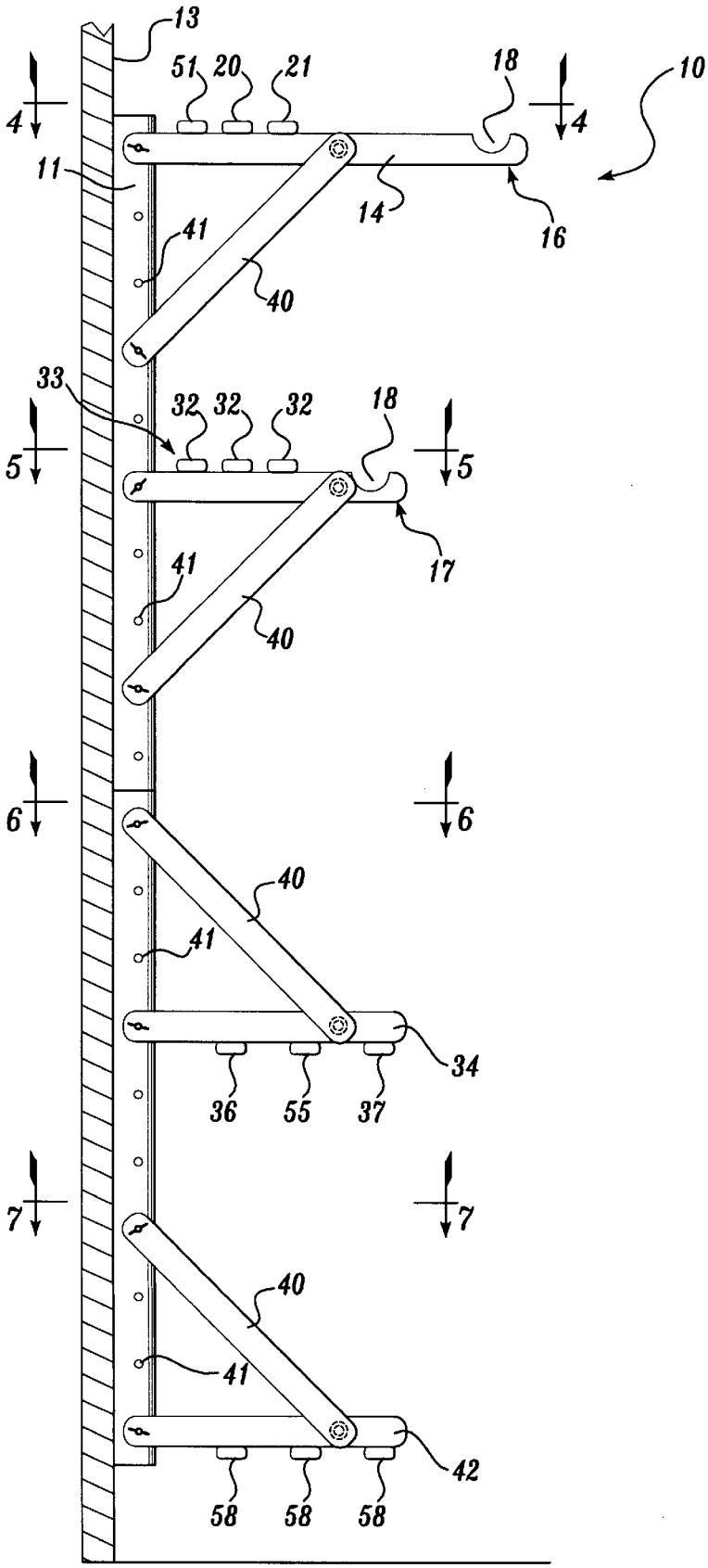
FIG. 3 is a side elevational view of the rack of FIG. 1.

A versatile, strong rack for storing sports equipment is provided in accordance with a preferred embodiment of the present invention. As illustrated in FIGS. 1 and 4–8, the rack 10 has a U-shaped bracket 45 having a first vertical member 11 and a second vertical member 12 mounted to a vertical support surface 13 in parallel, laterally spaced relation to each other. In particular, the first and second vertical members 11, 12 are coupled to a planar member 44 extending between the first and second vertical members, the planar member 44 being mounted to a wall. In a preferred embodiment, the rack 10 is coupled to a stud 61 in the wall, for example via screws 62, as seen in FIGS. 1 and 2. In a preferred embodiment, a first arm 14 is coupled to the first vertical member 11 and a second arm 15 is coupled to the second vertical member 12. The first and second arms 14, 15 are substantially parallel to each other and extend outward perpendicular to the vertical support surface. As best seen in FIGS. 1–3, a distal end 16 of the first arm 14 and a distal end 17 of the second arm 15 are both provided with a recess 18 to receive and support a bicycle frame 19.

Figure 4:
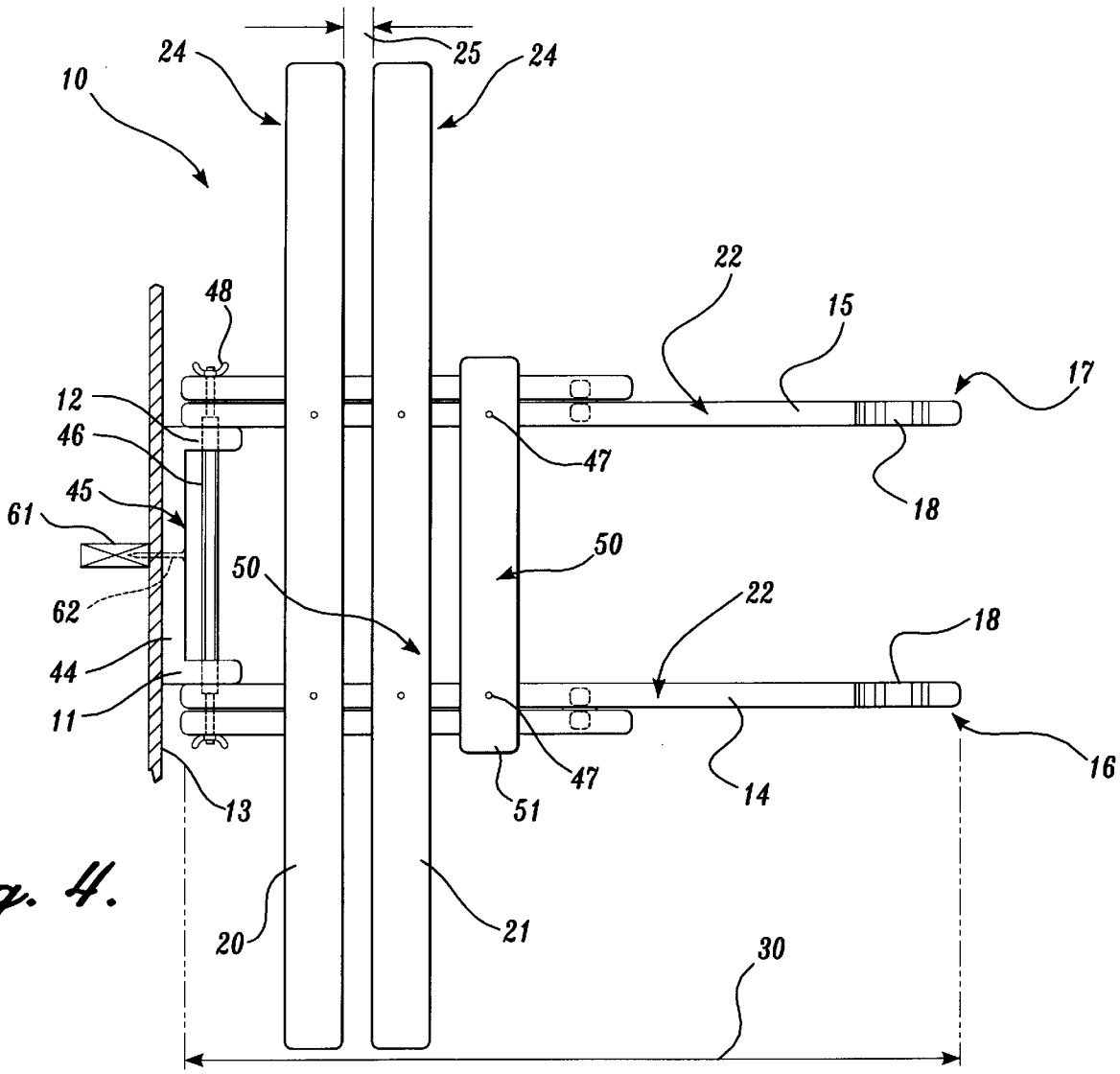
FIG. 4 is a top sectional plan view taken along line 4—4 of FIG. 3.
Figure 5:
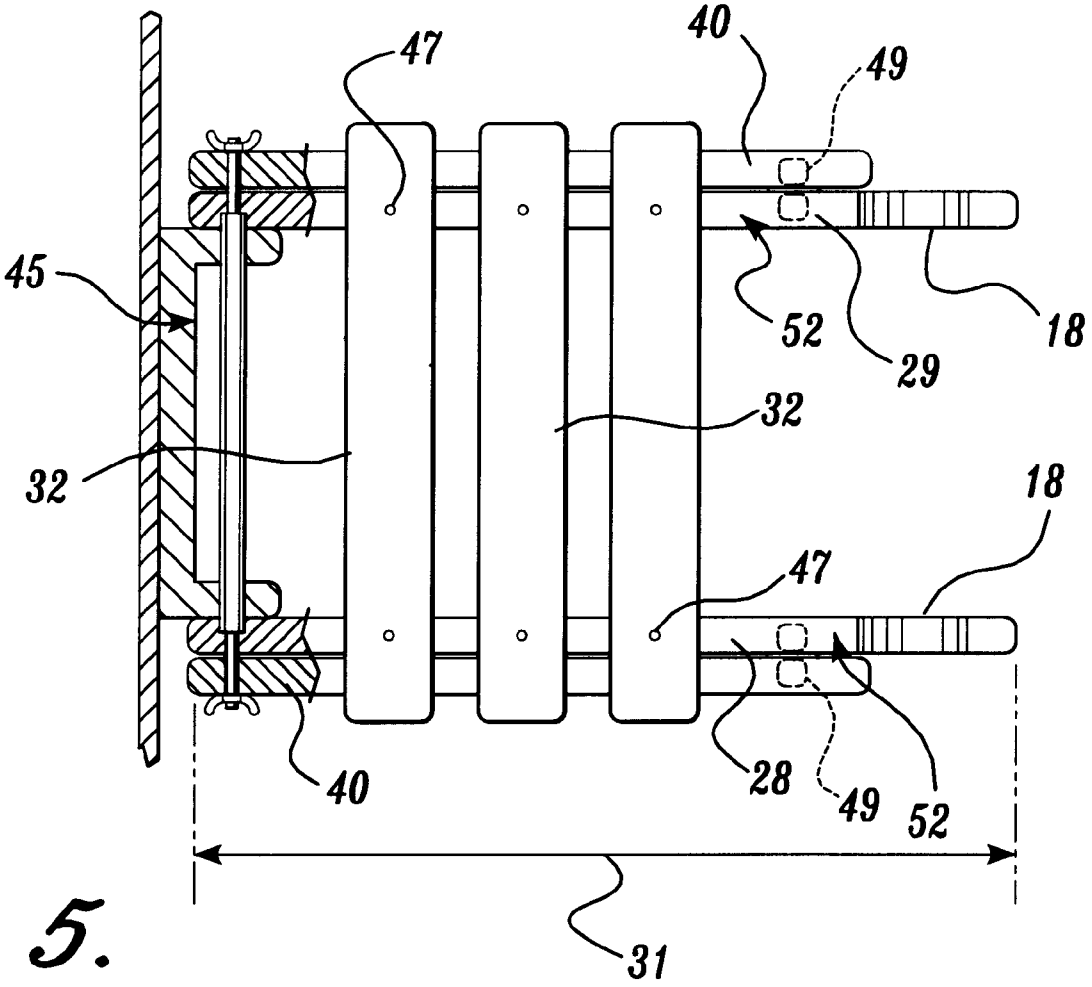
FIG. 5 is a top sectional plan view taken line 5—5 of FIG. 3.

In a preferred embodiment, as illustrated in FIGS. 1, 2, and 4, a first horizontal member 20 and a second horizontal member 21 extend laterally across and are coupled to an upper surface 22 of the first and second arms 14, 15. The first and second horizontal members 20, 21 are sufficiently long such that a portion 24 of the first and second horizontal members extends laterally outward beyond the first and second vertical members. The first and second horizontal members 20, 21 are substantially parallel, and are spaced apart by a distance 25 that is sufficiently narrow to catch and support the curved tips 26 of a pair of skis 27. In a preferred embodiment, the portion 24 of the first and second horizontal members 20, 21 that extends outward beyond the first and second vertical members 11, 12 is sufficiently long such that two pairs of skis may be suspended on either side of the first and second vertical members. It will be appreciated, however, that the length of the first and second horizontal members 20, 21 and their orientation relative to the first and second vertical members may be varied, to hold a selected number of pairs of skis, on one or the other or both sides of the rack.

In addition to supporting pairs of skis, the first and second horizontal members 20, 21 have an upper surface 50 that collectively form a horizontal support surface on which miscellaneous sports equipment may be placed. To increase the width of this horizontal support surface, an additional slat or horizontal member 51 is coupled to the upper surface 22 of the first and second arms, as best seen in FIG. 4.

In a preferred embodiment, a third arm 28 is coupled to the first vertical member 11 and a fourth arm 29 is coupled to the second vertical member 12. The third and fourth arms 28, 29 are substantially parallel to each other, and extend outward perpendicular to the vertical support surface 13. A recess 18 is provided in each of the distal ends of the third and fourth arms to receive and support a bicycle frame. In order to minimize the depth of space required to store two bicycles in addition to other equipment supported by the rack, the length 31 of the third and fourth arms differs from the length 30 of the first and second arms. In this manner, the two bicycles are supported in staggered relation to each other.

As illustrated in FIGS. 1–3 and 5, a plurality of slats 32 extend across and are coupled to an upper surface 52 of the third and fourth arms in parallel, spaced relation to each other to form a shelf 33. In a preferred embodiment, the slats 32 are laterally separated from each other by a gap having a width of substantially three inches, and extend outward beyond the first and second vertical members by a distance similar to the outward extension of horizontal members 20, 21. Therefore, if a user does not wish to suspend the skis 27 by the ski tips as described above, the skis can be inserted into the space between the slats 32 such that the ski bindings 23 are supported by the inner edges and top surface of the slats 32. Although in a preferred embodiment, multiple slats are coupled to the top surface of the arms, it will be understood that a solid planar member can alternately be coupled to the top surface of the arms to form a horizontal support surface to support and receive various sports equipment.

In a preferred embodiment, as illustrated in FIGS. 1–3 and 6, a fifth arm 34 is coupled to the first vertical member 11 and the sixth arm 35 is coupled to the second vertical member 12. The fifth and sixth arms 34, 35 are substantially parallel to each other, and extend outward perpendicular to the vertical support surface 13. A third horizontal member 36 extends across and is coupled to an upper surface 53 of the fifth and sixth arms, proximate the first and second vertical members. A fourth horizontal member 37 extends across and is coupled to the upper surface 53 of the fifth and sixth arms, distal to the first and second vertical members 11, 12. The length of each of the third and fourth horizontal members 36, 37 is sufficient such that a portion of the third and fourth horizontal members extends laterally outward beyond the fifth and sixth arms and beyond the first and second vertical members. The length and orientation of the third and fourth horizontal members 36, 37 relative to the fifth and sixth arms 34, 35 may be such that the third and fourth horizontal members extend outward beyond either or both of the first and second vertical members.

In a first preferred embodiment, where the third and fourth horizontal members extend laterally outward beyond the first vertical member, the third and fourth horizontal members, together with the fifth arm 34, collectively form a U-shaped recess 38 to receive and support a bag of golf clubs 39. If it is desired to support two golf bags on a single rack 10, the third and fourth horizontal members 36, 37 have a sufficient length to also extend laterally outward beyond the second vertical member, such that the third and fourth horizontal members, and sixth arm 35 collectively form a U-shaped recess 54 to receive and support a golf club bag. In a preferred embodiment, the third horizontal member 36 is spaced sufficiently from the first and second vertical members to allow the tails of the skis to hang behind the golf bags.

Figure 6:
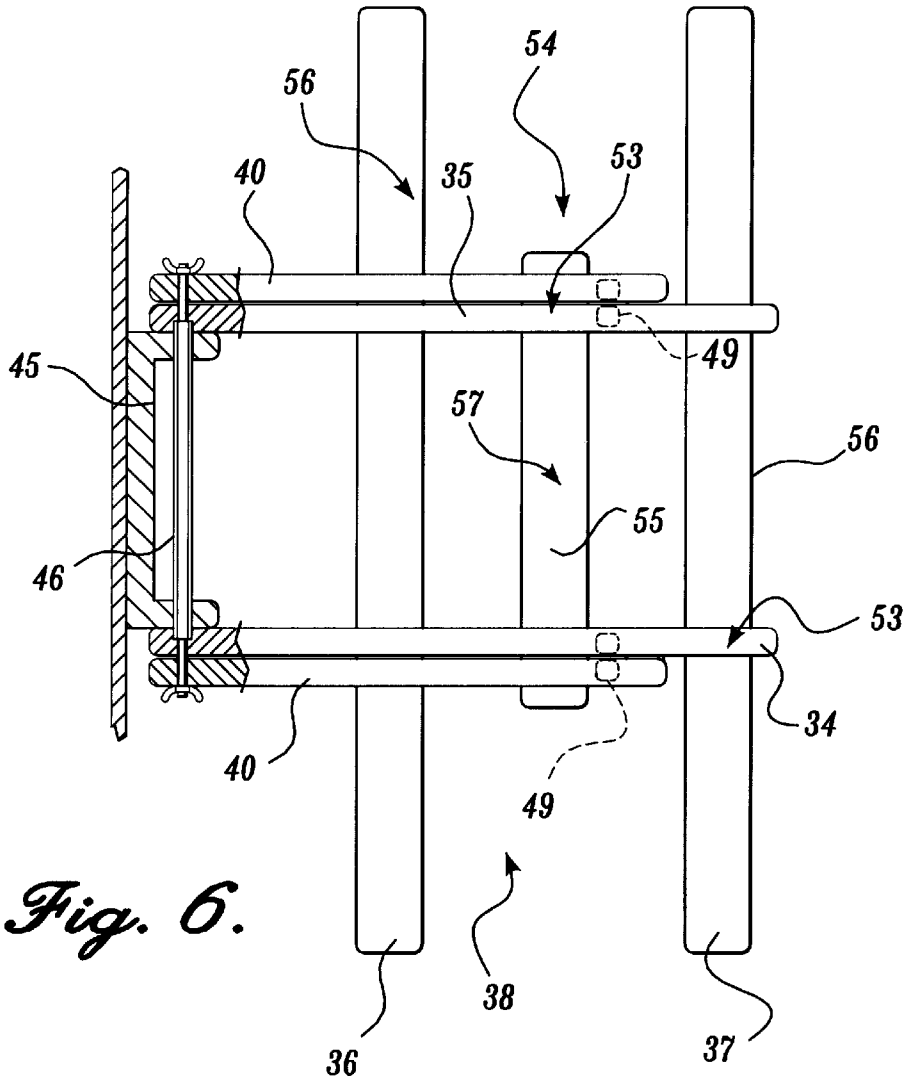
FIG. 6 is a top sectional plan view taken along line 6—6 of FIG. 3.
Figure 7:
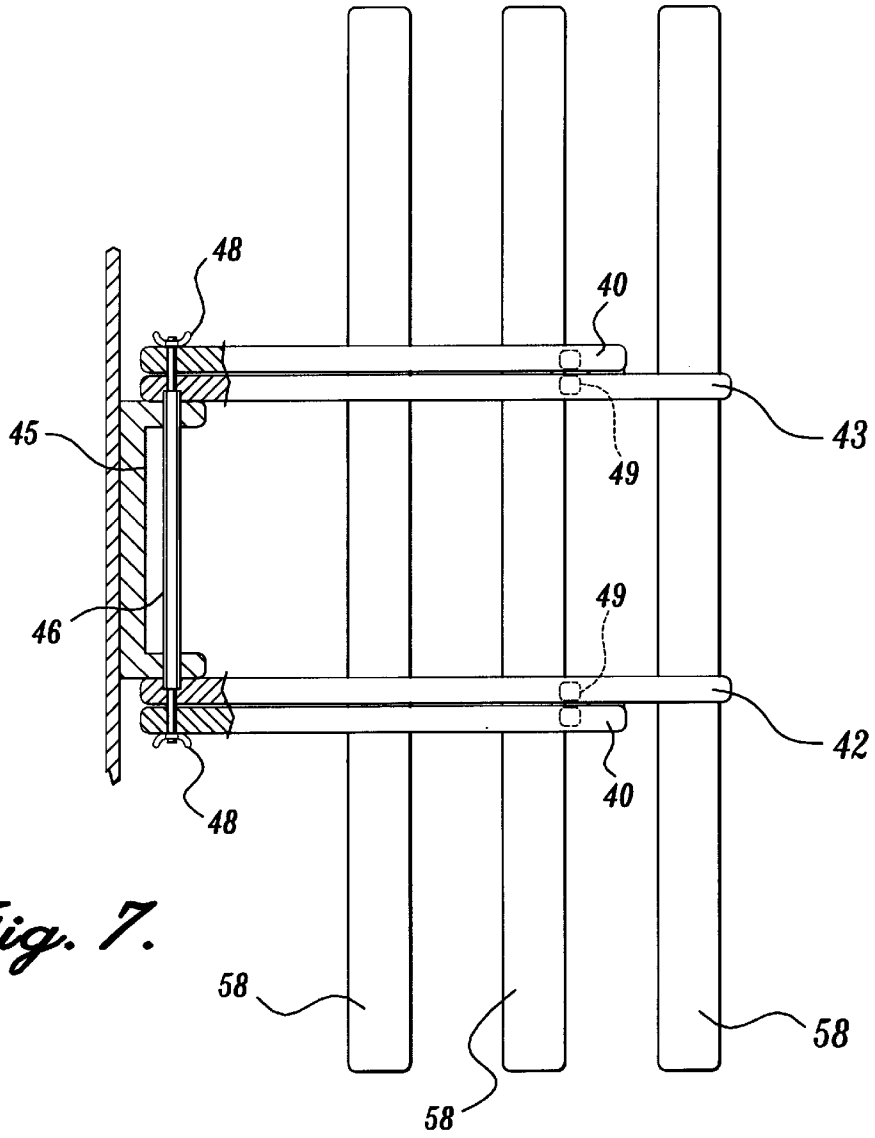
FIG. 7 is a top sectional plan view taken along line 7—7 of FIG. 3.

In a preferred embodiment, an additional slat 55 extends across and is coupled to the upper surface of the fifth and sixth arms between the third and fourth horizontal members, as best seen in FIG. 6. In this manner, the upper surface 56 of the third and fourth horizontal members and the upper surface 57 of the additional slat 55 jointly form a horizontal support surface to receive and store various athletic equipment.

In a preferred embodiment, as illustrated in FIGS. 1–3 and 7, a seventh arm 42 is coupled to the first vertical member 11 and an eighth arm 43 is coupled to the second vertical member 12. The seventh and eighth arms 42, 43 are substantially parallel to each other, and extend outward perpendicular to the vertical support surface 13. A plurality of horizontal members or bottom slats 58 extend across and are coupled to either a top or bottom surface of the seventh and eighth arms to form another horizontal support surface. In a preferred embodiment, the bottom slats 58 are sufficiently long and are spaced sufficiently close together to support the bottom of one or more golf club bags 39. As illustrated in FIG. 2, additional miscellaneous athletic equipment may be stored on the bottom support surface.

As best seen in FIGS. 1 and 3, a plurality of braces 40 extend at an angle between the first vertical member and each of the first, third, fifth, and seventh arms, and extend at an angle between the second vertical member 12 and the second, fourth, sixth, and eighth arms. The braces 40 provide further support and stability to the arms of the rack 10. In a preferred embodiment, the braces are positioned at a 45 degree angle relative to the arms and to the first and second vertical members.

Figure 8:
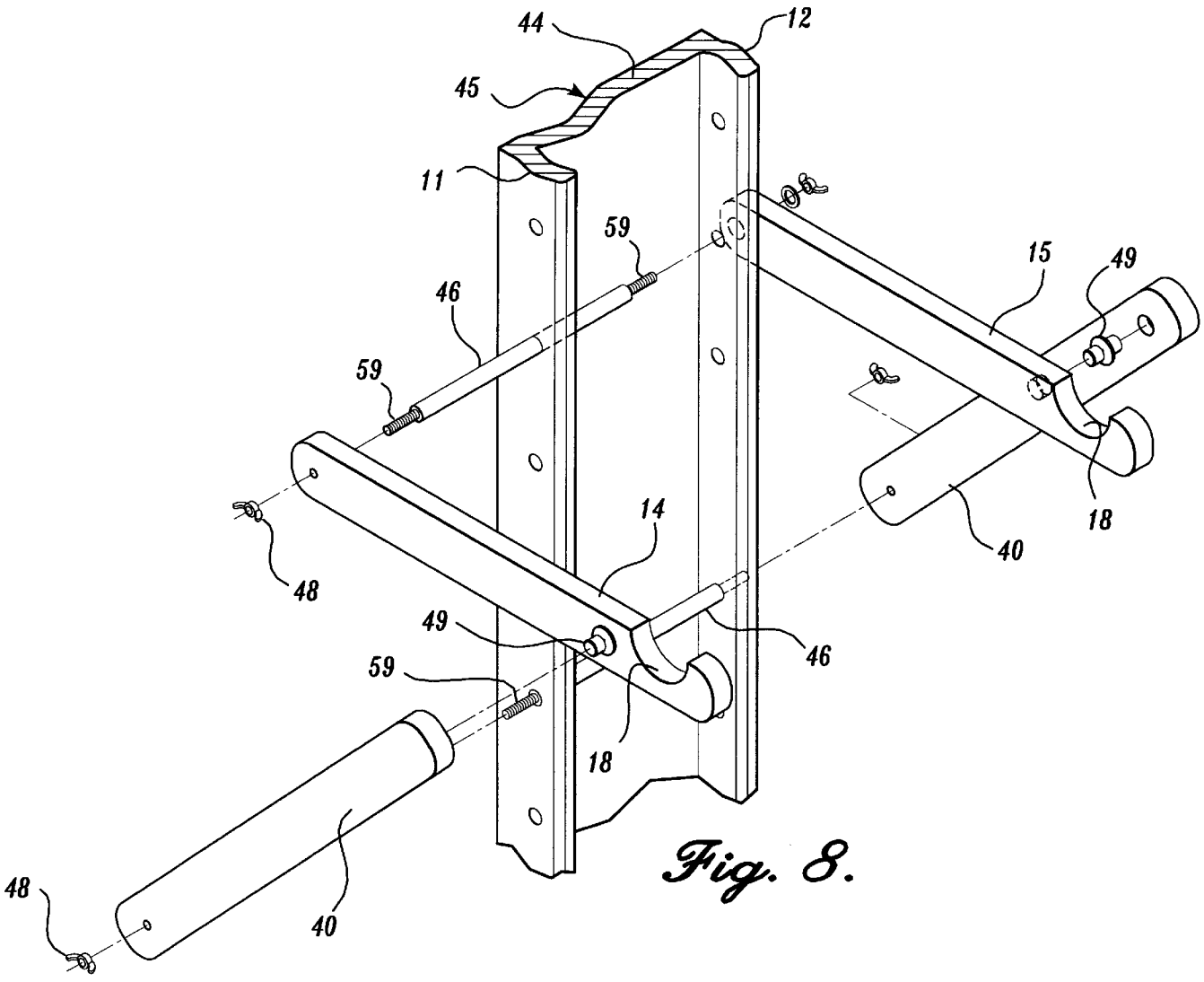
FIG. 8 is an exploded top plan view of a rack provided in accordance with a preferred embodiment of the present invention.
Figure 9:
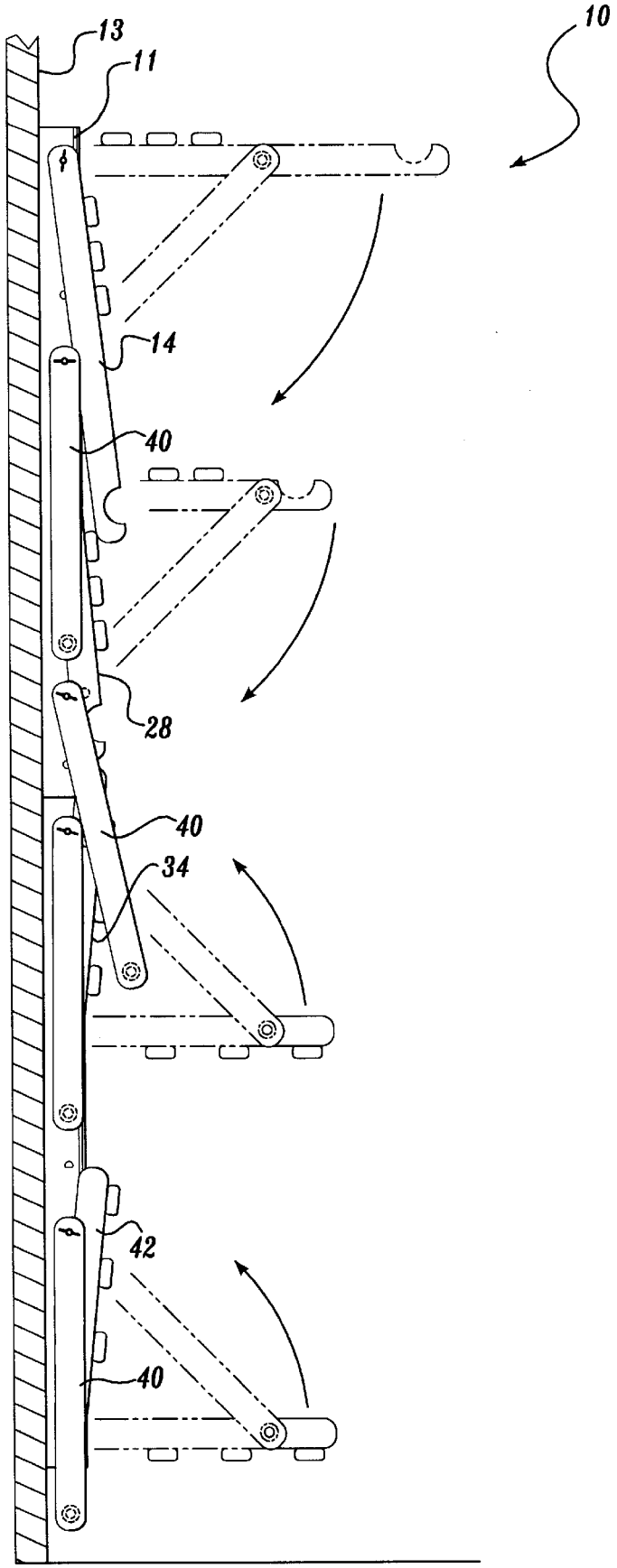
FIG. 9 is a side elevational view of the rack of FIG. 1 shown in a collapsed position.

The assembly of the rack is further illustrated in FIGS. 1 and 8. The first vertical member 11 is provided with a first plurality of holes 41 spaced along the length of the first vertical member. Similarly, the second vertical member 12 is provided with a second plurality of holes 60 spaced along the length of the second vertical member. The first set of holes 41 is vertically aligned with the second set of holes 60. A proximal end of each of the arms and of each of the braces is pivotally coupled to one of the first and second vertical members. The distal end of each of the braces is pivotally coupled to the associated arm. In this manner, each pair of arms and associated horizontal support surface may be pivotally moved to a folded, substantially collapsed position as illustrated in FIG. 9.

Although the pivotal coupling may be achieved in a variety of ways, in a preferred embodiment, a dowel 46 having a threaded screw 59 on either end extends between the first and second vertical members such that the threaded ends extend out through the holes provided in the first and second vertical members. The proximal end of each of the first and second arms is further provided with a hole, through which a threaded end of the dowel extends. A wing nut 48 is placed on each end of the dowel, thereby tightening the proximal ends of the first and second arms to the first and second vertical members, respectively.

Similarly, a dowel 46 having threaded ends 59 extends between aligned holes in the first and second vertical members and through holes provided in a first end of the angled braces 40 extending between the first and second vertical members and the first and second arms, respectively. Wing nuts 48 tighten and secure the first ends of the braces to the first and second vertical members. The joining of the opposite ends of the braces 40 to the first and second arms, respectively, is achieved by inserting a roto hinge 49 into aligned holes provided in the braces and in the arms. The roto hinge may be made of a variety of materials, for example wood or plastic.

The pair of the third and fourth arms and associated braces are coupled together and to the first and second vertical members in a similar fashion, as are the pairs of the fifth and sixth arms, seventh and eighth arms, and associated braces 40. The horizontal members and slats that make up the horizontal support surfaces or shelves, are coupled to the top surface of the associated arms by aligning predrilled holes in the horizontal members and top surface of the arms, and inserting screws 47 into the aligned holes. It will be understood that by providing a series of holes 41 and 60 along the length of the first and second vertical members, the location of the sets of arms may be selectively varied. Similarly, by providing a plurality of holes in the top of each arm aligned with a similar set of holes provided in the corresponding parallel arm, the horizontal members may be selectively spaced and coupled to the top surface of the arms, in a variety of locations provided by the location of the different holes. Although in a preferred embodiment, the rack 10 is made from wood, the various components may also be made from plastic, metal, composites, or other similar materials.

In this manner, a rack 10 provided in accordance with a preferred embodiment of the present invention holds a large quantity of various sporting equipment in a relatively narrow profile. As discussed previously, the location and arrangement of the arms and horizontal members are adjustable, allowing users to determine the manner in which their sports equipment is organized. The rack is strong and easy to assemble, and allows a user to access the equipment easily.

A sports equipment rack has been shown and described. From the foregoing, it will be appreciated that although embodiments of the invention have been illustrated and described, various modifications can be made without departing from the spirit of the invention. Thus, the present invention is not limited to the embodiments described herein, but rather is defined by the claims which follow.

The embodiments of the invention in which an exclusive property or privilege is claimed are defined as follows:

1. A rack for holding a variety of sports equipment, comprising:

a first vertical member and a second vertical member mounted to a vertical support surface in parallel, laterally-spaced relation to each other;

a first arm coupled to the first vertical member and a second arm coupled to the second vertical member, the first and second arms being substantially parallel and extending outward perpendicular to the vertical support surface;

a first horizontal member and a second horizontal member extending laterally across and coupled to an upper surface of the first and second arms, the first and second horizontal members forming a first horizontal support surface;

a third arm coupled to the first vertical member and a fourth arm coupled to the second vertical member, the third and fourth arms being substantially parallel and extending outward perpendicular to the vertical support surface, a distal end of at least two of the first, second, third, and fourth arms having a recess, a plurality of slats extending across and coupled to an upper surface of the third and fourth arms to form a second horizontal support surface;

a fifth arm coupled to the first vertical member and a sixth arm coupled to the second vertical member, the fifth and sixth arms being substantially parallel and extending outward perpendicular to the vertical support surface; and a third horizontal member, a fourth horizontal member and a fifth horizontal member extending across and coupled to a first surface of the fifth and sixth arms, the third fourth, and fifth horizontal members being substantially parallel and spaced apart such that the third horizontal member is coupled to the first surface of the fifth and sixth arms proximate the first and second vertical members, the fourth horizontal member is coupled to the first surface of the fifth and sixth arms distal to the first and second vertical members, and the fifth horizontal member is positioned between the third and fourth horizontal members, the third and fourth horizontal members having a sufficient length such that a portion of the third and fourth horizontal members extends laterally outward beyond the first vertical member, a length of the fifth horizontal member being less than the length of the third and fourth horizontal members, such that a U-shaped recess is formed between the third and fourth horizontal members, the U-shaped recess having a width that extends between the third and fourth horizontal members, an upper surface of each of the third, fourth, and fifth horizontal members jointly forming a third horizontal support surface.

2. The rack according to claim 1, wherein the first vertical member is provided with a first set of holes spaced along a length of the first vertical member and the second vertical member is provided with a second set of holes spaced along the length of the second vertical member, the first set of holes being vertically aligned with the second set of holes, the first set of holes providing a plurality of locations at which the first and third arms may be selectively coupled to the first vertical member, the second set of holes providing a plurality of locations at which the second and fourth arms may be selectively coupled to the second vertical member.

3. A rack for holding a variety of sports equipment, comprising:

a first vertical member and a second vertical member mounted to a vertical support surface in parallel, laterally-spaced relation to each other;

a first arm coupled to the first vertical member and a second arm coupled to the second vertical member, the first and second arms being substantially parallel and extending outward perpendicular to the vertical support surface;

a first horizontal member and a second horizontal member extending laterally across and coupled to an upper surface of the first and second arms, the first and second horizontal members having a sufficient length such that a portion of the first and second horizontal members extends laterally outward beyond at least one of the first and second vertical members, a top surface of the first and second horizontal members forming a first horizontal support surface;

a third arm coupled to the first vertical member and a fourth arm coupled to the second vertical member, the third and fourth arms being substantially parallel and extending outward perpendicular to the vertical support surface, a plurality of slats extending across and coupled to an upper surface of the third and fourth arms to form a second horizontal support surface;

a fifth arm coupled to the first vertical member and a sixth arm coupled to the second vertical member, the fifth and sixth arms being substantially parallel and extending outward perpendicular to the vertical support surface; and a third horizontal member, a fourth horizontal member and a fifth horizontal member extending across and coupled to a first surface of the fifth and sixth arms, the third fourth, and fifth horizontal members being substantially parallel and spaced apart such that the third horizontal member is coupled to the first surface of the fifth and sixth arms proximate the first and second vertical members, the fourth horizontal member is coupled to the first surface of the fifth and sixth arms distal to the first and second vertical members, and the fifth horizontal member is positioned between the third and fourth horizontal members, the third and fourth horizontal members having a sufficient length such that a portion of the third and fourth horizontal members extends laterally outward beyond the first vertical member, a length of the fifth horizontal member being less than the length of the third and fourth horizontal members, such that a U-shaped recess is formed between the third and fourth horizontal members, the U-shaped recess having a width that extends between the third and fourth horizontal members, an upper surface of each of the third, fourth and fifth horizontal members jointly forming a third horizontal support surface.

4. A rack for holding a variety of sports equipment, comprising:

a first vertical member, a second vertical member, and a planar member extending between the first vertical member and the second vertical member, the planar member having a length that is coextensive with a length of the first and second vertical members, the first vertical member, the planar member and the second vertical member collectively forming a U-shaped frame, the U-shaped frame being mounted to a vertical support surface;

a first arm coupled to the first vertical member and a second arm coupled to the second vertical member, the first and second arms being substantially parallel and extending outward perpendicular to the vertical support surface, a distal end of each of the first and second arms having a recess;

a first plurality of slats extending across and coupled to an upper surface of the first and second arms, in parallel relation to each other to form a first horizontal support surface; and a third arm coupled to the first vertical member and a fourth arm coupled to the second vertical member, the third and fourth arms being substantially parallel and extending outward perpendicular to the vertical support surface, a distal end of each of the third and fourth arms having a recess, the third and fourth arms having a length that differs from a length of the first and second arms, and a second plurality of slats extending across and coupled to an upper surface of the third and fourth arms in parallel relation to each other to form a second horizontal support surface.

5. The rack according to claim 4, further comprising:

a fifth arm coupled to the first vertical member and a sixth arm coupled to the second vertical member, the fifth and sixth arms being substantially parallel and extending outward perpendicular to the vertical support surface; and a first horizontal member and a second horizontal member extending across and coupled to the fifth and sixth arms, the first and second horizontal members being substantially parallel and spaced apart such that the first horizontal member is coupled to the fifth and sixth arms proximate the first and second vertical members and the second horizontal member is coupled to the fifth and sixth arms distal to the first and second vertical members, the first and second horizontal members having a sufficient length such that a portion of the first and second horizontal members extends laterally outward beyond the first vertical member such that the first and second horizontal members and the fifth arm collectively form a U-shaped recess.

6. The rack according to claim 5, further comprising:

a seventh arm coupled to the first vertical member and an eighth arm coupled to the second vertical member, the seventh and eighth arms being substantially parallel and extending outward perpendicular to the vertical support surface, a third plurality of slats extending across and coupled to the seventh and eighth arms in parallel relation to each other to form a third horizontal support surface.

7. The rack according to claim 4, further comprising:

a first plurality of braces extending at an angle between the first vertical member and each of the first and third arms, and a second plurality of braces extending at an angle between the second vertical member and each of the second and fourth arms, to provide further support and stability to the first, second, third and fourth arms.

8. The rack according to claim 4, wherein the first vertical member is provided with a first set of holes spaced along a length of the first vertical member and the second vertical member is provided with a second set of holes spaced along the length of the second vertical member, the first set of holes being vertically aligned with the second set of holes, the first set of holes providing a plurality of locations at which the first and third arms may be selectively coupled to the first vertical member, the second set of holes providing a plurality of locations at which the second and fourth arms may be selectively coupled to the second vertical member.

* * * * *